US005894789A

United States Patent [19]

Huber

[11] Patent Number: 5,894,789

[45] Date of Patent: Apr. 20, 1999

[54] TENSIONING ARRANGEMENT

[75] Inventor: Hans Huber, Bremgarten, Switzerland

[73] Assignee: Orgapack AG, Switzerland

[21] Appl. No.: 08/848,482

[22] Filed: May 8, 1997

[30] Foreign Application Priority Data

May 8, 1996 [CH] Switzerland ..... 1170/96

[51] Int. Cl.[6] ..... B65B 13/22

[52] U.S. Cl. ..... 100/4; 53/589; 100/32

[58] Field of Search ..... 100/4, 26, 29, 100/32; 53/589

[56] References Cited

U.S. PATENT DOCUMENTS

| | | | |
|---|---|---|---|
| 2,730,036 | 1/1956 | Cheesman | 100/32 |
| 3,327,618 | 6/1967 | Cook | 100/32 |
| 3,552,305 | 1/1971 | Dorney et al. | 100/32 |
| 4,559,767 | 12/1985 | Takami | 100/32 |
| 4,724,659 | 2/1988 | Mori et al. | 100/29 |
| 5,146,847 | 9/1992 | Lyon et al. . | |
| 5,179,892 | 1/1993 | Cicatello et al. | 100/32 |
| 5,467,701 | 11/1995 | Bartzick et al. | 100/29 |

FOREIGN PATENT DOCUMENTS

| | | | |
|---|---|---|---|
| 0194627 | 9/1986 | European Pat. Off. | 100/4 |
| 0621180 | 10/1994 | European Pat. Off. . | |
| 1152662 | 8/1963 | Germany | 100/32 |
| 33 00 039 | 7/1983 | Germany . | |
| 32 49 559 | 8/1985 | Germany . | |
| 295 13 482 | 12/1995 | Germany . | |
| 63-307008 | 12/1988 | Japan | 100/32 |
| 4-242507 | 8/1992 | Japan | 100/32 |
| 662791 | 10/1987 | Switzerland . | |
| 973417 | 11/1982 | U.S.S.R. | 100/29 |
| 1176711 | 1/1970 | United Kingdom . | |

*Primary Examiner*—Stephen F. Gerrity
*Attorney, Agent, or Firm*—Pillsbury Madison & Sutro, LLP

[57] ABSTRACT

A tensioning arrangement is provided for applying a tensioning force to a strapping band. The tensioning arrangement includes a guide for the strapping band, a transporting device which can move the strapping band, and a drive for the transporting device, such that a predetermined tensioning force can be applied to the band. The arrangement is developed by a clamping device for fixing a section of the band during a tensioning phase, and by the transporting device, which can move the clamping device and the band section fixed therein, along a path during the tensioning phase for the purpose of applying the tensioning force. The arrangement further includes a device for detecting a parameter value corresponding to the tensioning force. The detecting device is connected to a control device which, when a predetermined limit value is reached, causes the transporting device to stop.

13 Claims, 3 Drawing Sheets

TENSIONING ARRANGEMENT

BACKGROUND OF THE INVENTION

1. Field of the Invention

The invention relates to an arrangement which is intended for applying a tensioning force to a strapping band and is provided with a guide for the strapping band, with a transporting device which can move the strapping band, and with a drive for the transporting device.

2. Description of the Relevant Art

Various machines are already known for the purpose of applying a band or a plurality of bands by means of which an open or packed item is held together. Such machines serve to tension the band positioned around the item, to connect the band at the band ends, and to separate it from a supply roll. The operations of applying the band around the item which is to be strapped and of introducing the band, with the requisite overlapping of the band ends, into the machine may be carried out in a manual or automated manner in this case. However, in the case of machines which are provided with an arrangement of the generic type of the invention, the tensioning and subsequent connecting operations are usually carried out mechanically.

It is thus already known, for example, to route, and deflect, the band between at least two rubberized wheels, plastic wheels and/or belt drives, the band being tensioned with the aid of the resulting frictional forces. An arrangement of this type is described in Swiss Patent Specification 662 791. The disadvantage with this tensioning system, however, is that, as a result of the friction, the wheels and/or the belt drives wear relatively quickly, and the functional reliability is thus impaired. It cannot then be ensured that a specific desired tensioning force is actually applied to the band.

Other previously known tensioning systems which use a slotted drum for fixing a band end during the application of the necessary band tensioning are likewise unable to provide satisfactory results. In the case of such tensioning systems, it is necessary to fix in the drum a band section which is still connected to the band located on the supply drum. In particular when a high degree of band tensioning is to be applied, the band is subjected to considerable plastic deformation by buckling as a result of the slotted drum. It has been shown that such deformation has an adverse effect on functional capability, e.g. the tensioning force that can be applied.

Furthermore, it is also not possible in the case of such tensioning systems to compensate for the deviations from the desired tensioning force which occur as a result of disruptive influences. It is also disadvantageous that it is no longer possible for band sections deformed in this way to be transported reliably in guides of tensioning and closure heads. Since the deformed band section is the end of the respectively next strapping operation and still has to be transported through the entire guide, the only assistance which can be provided for this is to sever said band section prior to the next strapping cycle.

In the case of a further tensioning system which is already known, relative movement takes place between a tensioning lever and a so-called bell-shaped curve. A bell-shaped curve is to be understood as the contour of an end face of a rotatable cylinder on which one end of a tensioning lever is located. The tensioning-lever displacement caused by the rotary movement of the cylinder is used for tensioning the band. The disadvantage here, however, is that the path covered by the tensioning lever is predetermined by the bell-shaped curve and cannot be changed. Since the tensioning force applied to the band is dependent on a number of factors, for example the length, the material or the cross-section of the band, it is virtually impossible, given different use conditions, to apply a predetermined tensioning force to the respective band.

SUMMARY OF THE INVENTION

The object of the invention is thus to develop an arrangement of the type mentioned in the introduction such that, even given differing use conditions, it is always possible for a predetermined degree of tensioning, in particular a predetermined high degree of tensioning, to be applied reliably to the respective band.

In the case of an arrangement mentioned in the introduction, the object is achieved according to the invention by a clamping device for fixing a band section during a tensioning phase, and by the transporting device, which can move the clamping device, and the band section fixed therein, along a path during the tensioning phase for the purpose of applying the tensioning force, the arrangement being provided with a means for detecting a parameter value corresponding to the tensioning force, and the detecting means being connected to a control device which, when a predetermined parameter limit value is reached, causes the transporting device to stop.

A first basic aspect of the invention is thus, for the purpose of applying the desired tensioning force to the band, to use a parameter which can be determined during the tensioning operation and allows a conclusion as to the tensioning force already applied to the band. By limiting the maximum permissible actual value of the parameter (limit value), which corresponds at the same time to the desired tensioning force, it can be established whether this desired tensioning force has already been reached. Alternatively, it is also possible to determine the respective actual value of the parameters at any one time and to compare this with the limit value. The drive of the arrangement according to the invention continues to move the transporting device as long as the actual value of the parameter is smaller than the limit value, or as long as the limit value has not yet been reached. It is preferred to use a parameter which can be picked off, or detected, from the drive.

Unlike the abovedescribed solution with the bell-shaped curve, for example, it is thus not the case with the arrangement according to the invention that the path covered by the clamping device during the tensioning phase is rigidly predetermined. Rather, the tensioning path is variable and dependent on the actual present tensioning force, for which reason, regardless of the length or elasticity of the band, for example, the abovedescribed control means or regulating means can apply a predetermined tensioning force such that it can be repeated with accuracy.

A further aspect of the invention is the operation of applying tensioning to the band using a clamping device which is arranged on a pivot lever, fixes a portion of the band and is transported along a path. It is preferred here that, while the band is fixed in the clamping device, a band section drawn out of a closure station by the clamping device and/or the transporting device for the purpose of applying the tensioning is aligned in an essentially rectilinear manner. An essentially rectilinear alignment of the band is to be understood as meaning an arrangement in which the band is not subjected to plastic deformation by deflection. This alignment can be achieved in a particularly straightforward manner by the band section, which is fixed in the clamping device covering an essentially rectilinear tensioning path which is located at least approximately along the path of alignment of the band section between the closure station and the clamping device, before the band is fixed in the clamping device. This measure also helps to tension the band without subjecting it to plastic deformation. In this case, the transporting path may be completely rectilinear. It is likewise possible for the band, during this movement, to cover a path which deviates slightly from a rectilinear one, for example a path which is slightly curved in the form of an arc of a circle or in some other way. Such movements can be produced by relatively compact arrangements. In order that the abovedescribed rectilinear movement and the purpose thereof are realized at least approximately in this case, the radius of curvature used should be at least such that the limit of elasticity at the outer radius of a curvature possibly produced thereby in the band is not exceeded.

By realizing both aspects in the arrangement according to the invention, it is thus possible to achieve a predetermined tensioning force, in particular a constant high tensioning force, without thus deforming the fixed band section.

This manner of applying the tensioning force may be further assisted by the band also being clamped in the clamping device without buckling. This means that, even in the clamping device itself, the band is at least not subjected to any deforming deflection action. As a result, after the tensioning of the bands and opening of the clamping device, the band essentially regains its original shape again and resumes its original alignment.

For driving the transporting device of the arrangement according to the invention, it is possible to make use of basically virtually any drive principle (for example electrical, hydraulic or pneumatic). It is, however, preferred to provide an electric drive which drives only the transporting device. It is possible by means of such a drive, with a relatively low degree of design outlay, to provide suitable parameters which are dependent essentially only on the band tensioning, and not on other components of the machine as well. In a preferred embodiment of the invention, the torque present on the drive shaft is used as the parameter for determining the band tensioning. It is particularly preferred to use the motor current as a tensioning-force-dependent parameter. Such a control means or regulating means for monitoring the band tensioning may be provided in the case of both d.c. motors and a.c. motors. By limiting the maximum power consumption of the motor, it may be ensured that, on the one hand, the fixed band section is transported as long as the motor takes in the predetermined current and until the predetermined tensioning force has thus been reached. On the other hand, when the predetermined tensioning force is reached, the transporting device is stopped. This makes it possible to avoid overloading of the band or damage to the packed item.

BRIEF DESCRIPTION OF THE DRAWINGS

The invention is explained in more detail with reference to the exemplary embodiments illustrated schematically in the figures, in which.

DETAILED DESCRIPTION OF THE PREFERRED EMBODIMENT

Figure 1:
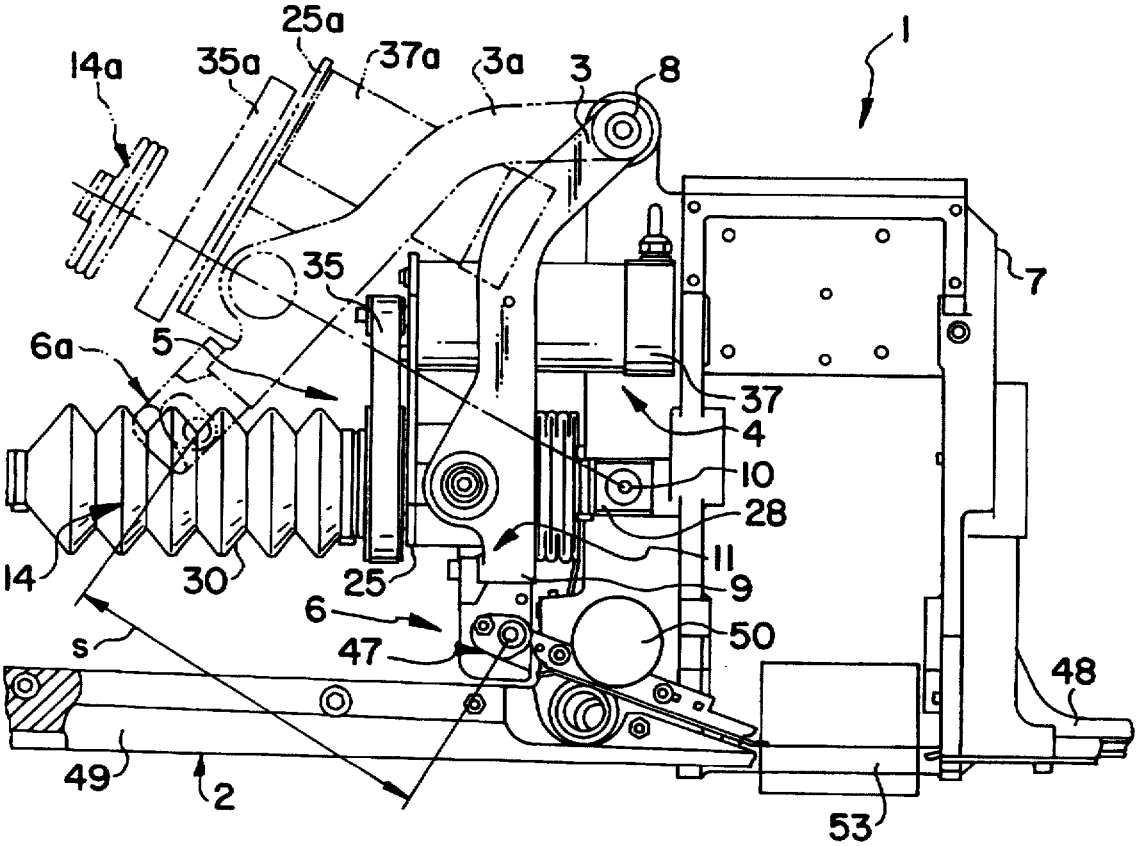
FIG. 1 shows a side view of a tensioning and closure head, on which an arrangement according to the invention is provided and is shown in two different positions.
Figure 2:
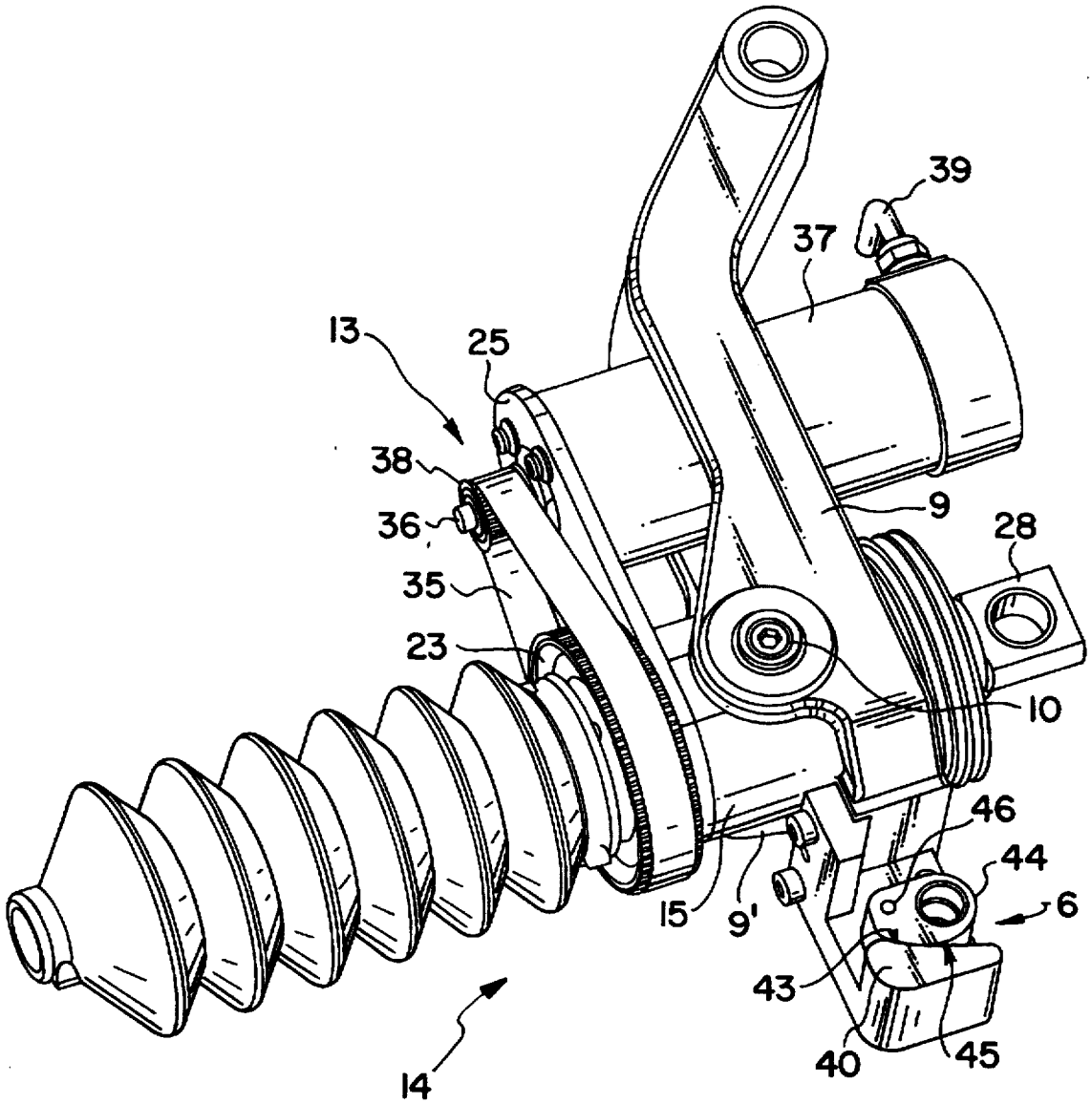
FIG. 2 shows a three-dimensional illustration of the arrangement according to the invention from FIG. 1.

The arrangement according to the invention, which is shown in FIGS. 1 and 2, is a constituent part of a so-called tensioning and closure head 1, by means of which a steel band or plastic band (not illustrated) is positioned around a packed item (likewise not illustrated) . For this purpose, the tensioning and closure head 1 rests on the packed item with its base surface 2. The arrangement has a transporting device 11, which is provided with a pivot lever 3, as well as a drive 4, a gear mechanism 5 and a clamping device 6.

The pivot lever 3, which is of fork-shaped design, is articulated pivotably on a housing 7 of the tensioning and closure head 1. For this purpose, the pivot lever 3 is provided with a rolling-contact bearing 8. Following a curve of the pivot lever 3, the latter is provided with two legs 9, 9' which are arranged in a fork-shaped manner and of which only one can be seen in the illustration of FIG. 1.

Figure 3:
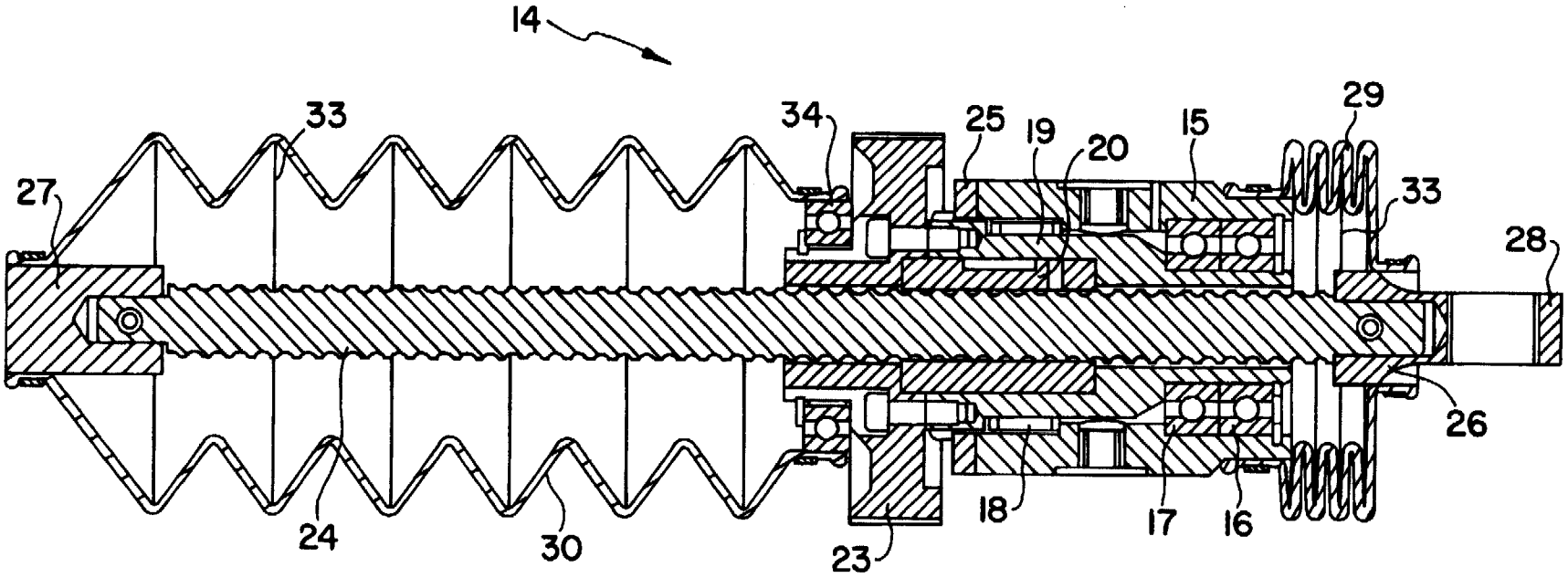
FIG. 3 shows a sectional illustration of the recirculating ball gear illustrated in FIGS. 1 and 2.

On the one hand, the gear mechanism 5 is fastened on the legs 9, 9'. On the other hand, the gear mechanism 5 is also articulated on the housing 7 such that it can be pivoted around a further bearing 10. The gear mechanism 5 essentially has a flexible drive 13 and a recirculating ball gear 14, which is illustrated in more detail, in particular, in FIG. 3. Said recirculating ball gear is fastened in a rotationally fixed manner, by means of a nut 15, on the legs 9, 9'. The nut 15 is supported, via rolling-contact bearings 16, 17, 18, on transmission sleeves 19, 20, which are essentially arranged coaxially in the nut. The transmission sleeve 19 is connected in a rotationally fixed manner, by means of screws, to a gear wheel 23. The second transmission sleeve 20 bears on balls, which are arranged in threads and are not illustrated, of a threaded spindle 24 of the recirculating ball gear 14. Furthermore, a bearing plate 25, only part of which is illustrated, is arranged in a rotationally fixed manner around the threaded spindle 24.

The threaded spindle 24, which is secured against rotary movements, is fastened, at its two thread-free ends, in mounts 26, 27 in each case. The mount 26 is provided with a bearing journal 28 for the pivotable arrangement of the recirculating ball gear 14 on the housing 7. Furthermore, between the mount 26 and the nut 15 and between the mount 27 and the gear wheel 23, the threaded spindle 24 is located in a rotationally fixed folding bellows 29, 30, respectively, each of these folding bellows being provided with spacer discs 33 The two folding bellows 29, 30 are each arranged in a rotationally fixed manner, for which purpose the bellows 30 is mounted on a further ball bearing 34.

In addition to the gear wheel 23 and a toothed belt 35, the flexible drive 13 also has a pinion 38, which is arranged on a drive shaft 36 of a d.c electric motor 37. The diameter of the gear wheel 23 and the diameter of the pinion 38 are coordinated with one another such that the rotary movement of the shaft 36 is geared down.

The electric motor 37, which is arranged with its drive shaft 36 essentially parallel to the threaded spindle 24, is fastened on the rotationally fixed bearing plate 25. The position of the electric motor 37 is thus fixed with respect to the threaded spindle 24. Electric leads 39, of which only one is illustrated, connect the electric motor 37 to a power source (not illustrated) and a control device. The maximum current which is to be supplied to the electric motor 37 can be set, as limit value, at the control device in an infinitely variable manner and such that it can be repeated with accuracy. An electric circuit designed as detecting means determines the actual motor-current value at any one time and compares this value with the predetermined limit value. Such circuits for limiting the current are known per se to the person skilled in the art, and a more detailed discussion of the design of such circuits is thus rendered superfluous here.

The abovementioned clamping device 6 is fastened on the legs 9, 9', in the region of the ends of the latter, beneath the nut 15. The clamping device 6 has a clamping plate 40 with a contoured bearing surface 43, over which there is arranged a pivotable clamping cam 44 which is provided with a correspondingly contoured pressure-exertion surface 45. The clamping cam 44 can be pivoted around a bearing 46 such that the pressure-exerting surface 45 comes to rest on the bearing surface 43. Since the surfaces 43, 45, between which the band can be clamped, are contoured, the band can be retained particularly securely. However, the contouring, which essentially comprises curves which are congruent with one another, is performed such that the alignment of the band remains essentially uninfluenced by the fixing.

In order to position, for example, a steel band or plastic band around a packed item (not shown in the figures), the band is introduced, between the clamping plate 40 and the clamping cam 44, into a guide 47 (only schematically illustrated) of the tensioning and closure head 1 (FIG. 1). In this case, the band is introduced into a first guide rail 48, positioned around the packed item, and inserted into a second guide rail 49 of the guide 47. The necessary operation of drawing the band off from a supply roll (not shown) is carried out by a transporting roller 50. The end of the band is then fixed in a clamping station (not illustrated) of the tensioning and closure head. Consequently, a section of the band which has already been routed around the packed item and a second section of the band which is located between the transporting roller 50 and the first guide rail 48 overlap one another beneath a closure station 53 (merely schematically illustrated).

In order to provide the band with the envisaged tensioning force, said band is then clamped between the clamping plate 40 and the clamping cam 44, with the result that said clamped section cannot move relative to the clamping device 6.

Thereafter, the control means of the arrangement, said control means making it possible for said arrangement to be controlled separately from the other components of the tensioning and closure head 1, causes the electric motor 37 to be supplied with power. The rotary movement of the shaft 36 of the electric motor 37 is then transmitted to the gear wheel 23 by way of the pinion 38 and the toothed belt 35 of the flexible drive 13. Being operatively connected to the threaded spindle 24, the transmission sleeves 19, 20, which are likewise set in rotation as a result of the above, also execute, in relation to said threaded spindle, a translatory movement in the direction of the mount 27. Furthermore, the rotationally fixed nut 15, which is operatively connected to the transmission sleeve 19, 20, is carried along, together with the pivot lever 3, during this movement.

On the one hand, this results in the lever 3 pivoting around the bearing 8 from a first end position into a second end position. On the other hand, the recirculating ball gear 14 pivots around the bearing 10. As a result of these two movements, the components of the gear mechanism 5 which are arranged on the threaded spindle 24 are displaced in a rectilinear manner relative to said spindle. Since the clamping device 6 is also carried along during this movement, the band section clamped in it covers a path corresponding to an arc of a large radius circle, as a result of which the band is tensioned. In the illustration of FIG. 1, a path covered by the clamping device is shown approximately as the distance s between the two positions of the clamping device. As can also be seen from the illustration of FIG. 1, the transporting band section drawn out of the closure station 53 in the tensioning direction by the transporting device 11 during the tensioning phase is essentially always aligned in a rectilinear manner. Said transporting section is regarded here as that band section which becomes ever-longer during the tensioning phase and is located between the closure station 53 and the clamping device 6. Depending on the length of the tensioning path, the transporting section of the band may be subjected, at most, to slight deflection by the transporting roller 50. This deflection, however, is so small that the resulting stressing of the band is beneath the limit of the elasticity of said band. Ideally, the transporting section is thus subjected essentially only to tensile stressing during the tensioning phase.

Once the actual value, determined by the detecting means, of the current of the electric motor 37 has reached the limit value, this current value is kept constant by the control means until the overlapping ends of the band are connected to one another. Alternatively, it may also be provided that, when the limit value is reached, the pivot lever 3 is arrested and the electric motor 37 is switched off. In FIG. 1, chain-dotted lines are used to illustrate part of the arrangement according to the invention in the position in which it is located when a limit value is reached. The components of the arrangement which are illustrated in this position are each provided with an index "a".

In contrast to the previously known tensioning systems, the arrangement according to the invention places no importance, for the purpose of applying the tensioning force, on the length of the path covered by the band during the tensioning phase. All that has to be ensured is that the maximum displacement of the recirculating ball gear is sufficient for achieving the limit value of the current, and thus for the tensioning force which is to be applied.

Once the desired tensioning force has been applied to the band, the closure device 53 is used. The latter adds a lead seal to the two abovementioned band sections located one above the other, or closes the band in some other way, for example by friction welding or thermowelding. Other lead-seal-free closures, e.g. by using notching, are also possible. This concludes the strapping operation.

It is possible to determine for each band, on the basis of straightforward tests, the functional relationship between various values of the belt tensioning and the motor current required for this purpose. It is thus also possible to determine each intermediate value by interpolation. The functional relationship between the respective (mechanical) tensioning of a certain type of band and the respective value of the current is expediently stored in an electronic storage unit of the control means. Of course, it is also possible for one storage unit to store this relationship for a number of different band types. This means that it is possible, for each band which can be used, to set any desired tensioning or tensioning-force value at the control means in an infinitely variable manner.

I claim:

1. An arrangement for applying a tensioning force to a strapping band, comprising:

a transporting device including a pivot lever and a drive, the pivot lever being pivotally mounted on a housing, the transporting device being moved according to a motion of the drive;

a clamping device arranged on the pivot lever, in which a section of the strapping band can be fixed in the clamping device and moved along a path during a tensioning phase;

a guide for guiding the strapping band into the clamping device;

means for detecting a parameter value corresponding to the tensioning force; and a control-device connected to the detecting means and causing the transporting device to stop when a predetermined value is reached.

2. An arrangement according to claim 1, wherein the drive is provided exclusively for producing a transporting movement of the transporting device.

3. An arrangement according to claim 1, wherein the detecting means detects parameter values from the drive.

4. An arrangement according to claim 3, wherein the detecting means determines the parameter value based on a torque of the drive.

5. An arrangement according to claim 1, wherein a parameter limit value can be set in an infinitely variable manner.

6. An arrangement according to claim 1, wherein the strapping band to be tensioned is aligned in an essentially rectilinear manner over the path by the transporting device.

7. An arrangement according to claim 1, wherein the drive is operatively connected to the pivot lever by a flexible drive.

8. An arrangement according to claim 1, wherein the drive is operatively connected to a recirculating ball gear.

9. An arrangement according to claim 8, wherein the recirculating ball gear is pivotably arranged.

10. An arrangement according to claim 1, wherein:

the drive comprises an electric motor, and the detecting means determines the parameter value based on a power consumption of the electric motor.

11. An arrangement for applying a tensioning force to a strapping band, comprising:

a transporting device including a pivot lever and a drive, the pivot lever being pivotally mounted on a housing, the transporting device being moved according to a motion of the drive;

a clamping device arranged on the pivot lever, in which a section of the strapping band can be fixed in the clamping device and moved along a path during a tensioning phase;

a guide for guiding the strapping band into the clamping device;

a detector constructed and arranged to detect a parameter value corresponding to the tensioning force; and a control device connected to the detector and causing the transporting device to stop when a predetermined value is reached.

12. An arrangement for applying a tensioning force to a strapping band, comprising:

a transporting device including a pivot lever and a drive, the pivot lever being pivotally mounted on a housing, the transporting device being moved according to a motion of the drive;

a clamping device arranged on the pivot lever, in which a section of the strapping band can be fixed in the clamping device and moved along a path during a tensioning phase;

a guide for guiding the strapping band into the clamping device;

a detector constructed and arranged to detect a parameter value corresponding to the tensioning force; and a control device connected to the detector and when the detector detects that the parameter value has reached a limit value, the control device maintains the parameter value at a constant value until overlapping ends of the strapping band are connected.

13. An arrangement according to claim 12, wherein:

the drive comprises an electric motor, and the parameter value corresponds to a value of a current of the electric motor.

* * * * *